US006691349B2

(12) United States Patent
Blevins

(10) Patent No.: US 6,691,349 B2
(45) Date of Patent: Feb. 17, 2004

(54) PATIENT BED WITH LEG LIFTER

(76) Inventor: Jerry Blevins, 109 Farm Hill Dr., Toms Brook, VA (US) 22660

( * ) Notice: Subject to any disclaimer, the term of this patent is extended or adjusted under 35 U.S.C. 154(b) by 51 days.

(21) Appl. No.: 09/796,368

(22) Filed: Mar. 2, 2001

(65) Prior Publication Data

US 2001/0008028 A1 Jul. 19, 2001

Related U.S. Application Data

(63) Continuation-in-part of application No. 08/835,991, filed on Apr. 11, 1997, now Pat. No. 5,996,150.
(60) Provisional application No. 60/186,345, filed on Mar. 2, 2000.

(51) Int. Cl.[7] ..... A47B 83/04

(52) U.S. Cl. ..... 5/613; 5/81.1 R; 5/86.1

(58) Field of Search ..... 5/613, 81.1 R, 5/87.1, 86.1, 612

(56) References Cited

U.S. PATENT DOCUMENTS 4,193,147 A * 3/1980 Fischer ..... 297/DIG. 4
4,255,823 A * 3/1981 Boyer et al. ..... 280/47.16
4,432,359 A * 2/1984 James ..... 297/487

* cited by examiner

*Primary Examiner*—Teri Pham Luu
*Assistant Examiner*—Fredrick Conley
(74) *Attorney, Agent, or Firm*—Hoffman, Wasson & Gitler, PC

(57) ABSTRACT

A cantilevered mobile bed/chair apparatus for safely transferring a patient from and to a hospital type bed comprises three hinged together segments forming back, seat and foot platforms operating in conjunction with a four wheeled, rectangular base. The hinged together platforms convert from a fully adjustable chair mode to a bed mode by a first jack located beneath the seat platform. The platforms are raised and lowered by a second jack associated with a telescoping tower attached to an E frame. The telescoping tower is mounted vertically from one side of the rectangular base, and when extended, has a height greater than a hospital bed. The E frame, which supports the platforms, is cantilevered horizontally from the top portion of the telescoping tower, and the height thereof is controlled by the second jack mounted together with the bottom portion of the telescoping tower, to the wheeled base. The side edges of the platforms are beveled or angled downward. When it is desired to transfer a patient from a hospital bed to the bed/chair apparatus, the unit is wheeled over in the bed mode. The lower height is extended by the second jack which enables the platforms to overhang in cantilever fashion the hospital bed by up to eighteen inches, and then lowered so as to press into the mattress of the hospital bed. The angled down edges of the platforms pressing into the mattress results in a tight embrace of the hospital bed, and an almost flat profile for the two beds so that a single caregiver can safely effect the patient transfer. Numerous other features are included for medical and physical maintenance of the patient.

14 Claims, 11 Drawing Sheets

PATIENT BED WITH LEG LIFTER

This application is a continuation-in-part application of Ser. No. 08/835,991, filed on Apr. 11, 1997, now U.S. Pat. No. 5,996,150, This application also claims the benefit of Ser. No. 60/156,345 filed on Mar. 2, 2000.

FIELD OF THE INVENTION

This invention relates to a mobile bed and chair combination for patients in hospitals, nursing homes, or similar health care facilities including the home in which the safe transfer of the patient from a hospital type bed is contemplated by a single healthcare giver.

BACKGROUND OF THE INVENTION

There are various devices known in the art for transporting the disabled from one place to another. The most commonly known is the wheelchair either powered or non-powered. In the hospital and nursing homes, gurneys are used to transfers the patient from one place to another while remaining in a lying or prone position. Often it is necessary to transfer the patient from the hospital bed to a gurney type bed of wheelchair. Studies have shown that upwards to fifty percent of all injuries to either patients or healthcare people have occurred when the patient is being transferred from the bed to a gurney or to a wheelchair. That is, when a patient is transferred from a bed to a wheelchair, the patient must first be raised to a sitting position, rotated so that their feet are over the side of the bed, and then lifted form the bed to the chair. This usually requires three people for a safe transfer, two to lift the patient off the bed, and one to rotate the patient and gently guide him into the chair. Similarly, if the patient is to be transferred from a bed to a gurney, two and sometimes three people are required for a safe transfer, two to lift the patient and one to stabilize the gurney.

Unfortunately, the realities of the healthcare situation in our country and indeed over the world, have stretched the healthcare dollar so thin that many of our provider institutions can no longer provide the necessary personnel to ensure the safe transfer of patients in the above described situations. Instead of the two or three people required to perform the patient transfer, often only one is available. As is often the case, the patient is of a size or weight that is difficult for the healthcare giver to manage by him or herself. The result is either the patient is dropped or the healthcare person sustains a back injury. Such a state of affairs only exacerbates an already strained industry in terms of lost time and money for both the healthcare giver and institution; and the ill will of, or a lawsuit by, the patient should further injury result.

The prior art has attempted to relieve the situation by providing combination wheelchair and bed mechanisms. For example, the patent to Crawford et al, U.S. Pat. No. 5,402,544, discloses a combination chair and gurney which permits one device to operate both as a wheelchair and as a gurney. The object of Crawford et al is to attend to the bodily needs of a disabled person. In Crawford et al, the chair can be converted to a bed and then hand cranked to a height to correspond to a bed height. The mobile bed is then placed adjacent the bed and held stabilized by "elastic bungee cords" connected between the rails of the bed and the Crawford et al device (col. 5 line 25 of Crawford et al). The problem with Crawford et al is that there is still a gap between the two beds, and an uncomfortable obstacle in the form of the rails to negotiate in the patient transfer.

Moreover, there is, over time, a very real possibility of the bungee cord breaking with disastrous consequences. Another patent t Ezenwa, U.S. Pat. No. 5,193,633, is designed in particular for paraplegics in a home environment. This patent also shows a chair converting to an adjustable height bed device, and, has a lateral shifting mechanism for use in the wheelchair mode so that the each of reaching over the head by the disabled can be effected. This lateral shifting is stabilized as to the center of gravity by a tilting of the chair toward the center of the wheeled platform. See FIGS. 6 and 7 of Ezenwa. Thus, while this feature is effective for the patient when he reaches high over his head to keep him stabilized, it is counterproductive to the transfer of the patient from the mobile bed to another bed because it presents both a gap between the beds and a raised obstacle therebetween (due to the tilting). This patent like Crawford et al above is seen to require at least two or maybe three people to effectuate a safe transfer of the patient. Another prior art attempt to address the problem of transporting patients from a bed to a convertible wheelchair/bed structure is disclosed by a patent to Jones, U.S. Pat. No. 4,119,342. In this patent, the wheelchair converts to a bed mode of a fixed height (equal to the height of the wheelchair arms). Thus, it is required that the bed in which the patient is lying be lower than this fixed height, so that the bed mode will then hang over the bed by up to seven inches to perform the transfer. This apparatus suffers from three drawbacks. One, the bed must be lower in height than the Jones device because the device is not adjustable; two, assuming the bed is lower, the obstacle created by the thickness of the platform structure (wheelchair arms and pad) would cause a difficult transfer procedure, if not insurmountable if the bed is even one or two inches below the Jones' bed platform; and three, a seven inch overlap has been found by the inventors hereof to be inadequate to ensure a safe patient transfer by one person. This is because in maneuvering the patient onto beds of different heights, there is usually slippage between the bed structures when one person attempts the transfer. Thus, it is seen that, once again, two and probably three people would be required to safely effect a patient transfer in Jones. Other adjustable height wheelchair to bed structures are disclosed by Burke et al, U.S. Pat. No. 5,342,114, and Herbert et al, U.S. Pat. No. 5,179,745. These patented structures, like Crawford et al, above, are only able to be located next to the bed in which the patient is lying. Moreover, these prior art teachings, unlike Crawford et al, have no bungee cords to help hold the two bed structures together. Thus, a minimum of three people are seen needed to transfer a patient from one bed to the other.

SUMMARY OF THE INVENTION

The present invention is directed to a cantilevered mobile bed/chair that, while in its bed mode, is able to overhang a conventional thirty six inch width hospital type bed by up to half its width in cantilevered fashion so that a safe transfer of a patient can be effected, even by a single caregiver. After the transfer, the patient can then be transported by either remaining in the bed mode, or converted into a chair mode for further patient care. The objects of this invention are carried out by a unique lift structure providing cantilever support for a series of three hinged together platforms making up back, seat and foot portions of the chair/bed. The lift structure comprises a telescoping tower which mounts vertically on one side of a rectangular shaped wheeled base. The platforms comprise the patient support for the bed/chair, and are operatively coupled to an E-shaped frame structure that in turn is mounted in cantilever fashion horizontally from the telescoping tower controlled by a screw type jack associated therewith. While a screw jack is provided, it is obvious that other jacks such as hydraulic and scissors may be employed. With this offset tower and cantilever E frame design, the remote side (to the tower of the platforms of the apparatus int eh bed mode are able to overlap a hospital type bed by up to eighteen inches, or half the bed width of a conventional, thirty six inch wide hospital type bed. Thus, when it is desired to transfer a patient from or to a hospital type bed to the apparatus, the jack controlling the telescoping tower operates to raise the platforms above the bed, the apparatus wheeled over to overlap the bed by up to eighteen inches, and then lowered to press into the bed's mattress. Moreover, the platforms comprising the bed are of a thin, highly strong material in which the side edges thereof are beveled or angled downward. This angle down design enables the platforms to further press into the mattress of the hospital type bed, not only ensuing that virtually no movement occurs therebetween, but that a substantially flat profile is presented for the two beds even with a one inch pad on the mobile bed. With such a relatively flat profile, and with the two beds locked in such a tight embrace, it becomes an easy matter for just one caregiver to manage a patient in a transfer procedure.

Although the lift mechanism of the invention can be carried out manually, the best mode comprises an electrically powered lift arrangement. That is, an electric motor is mounted to control a screw jack which is powered by a battery located at the wheeled base of the apparatus. The three platforms forming the head, seat and foot supports are connected by low profile piano hinges. Another electrically driven screw jack is mounted below the seat platform and controls the conversion of the bed into a chair configuration by way of levers and hinges. This second jack, like the first one, is mounted near the tower side of the unit so as to not interfere with the cantilevered overhang portion of the platforms. The chair mode may be under the control of either the caregiver or the patient, and features indefinite adjustment for patient comfort. In the case of immobilized patients, there is an auto seat reposition timer feature associated with the chair mode that periodically readjusts the sitting position to minimize bedsores. The seat platform includes a potty hole for increased patient maintenance. The wheeled base, besides providing support for the tower, accommodates, four, omni-directional wheels that may, in some models, be electrically powered; a hazard-free dry-cell, rechargeable battery and holder therefor; and a battery recharging unit. The back platform has provision for an oxygen bottle, while the foot platform includes an adjustable foot rest. The platforms comprising the bed include VELCRO straps for patient safety. The tower also accommodates an IV holder; combination food tray holder and arm rest that swings into position as needed; and a module for the auto seat reposition timer mentioned above.

Another object of the invention is to provide for a Trendelenburg position bed or where the bed is positioned to have the head lower than the feet. This is accomplished in the bed mode, one of several ways; one, by providing a multi-position gear and locking pin mechanism connected between the tower and E frame, or two, by way of a swing down jack mounted on the E frame. Thus, for example, in the case of the pin and gear arrangement, the pin is pulled and the E frame which is connected to the gear is rotated to be tilted to the desired position, and the pin reinserted to lock the bed in the Trendelenburg position.

A further object of the invention is to allow for portability of the apparatus by keeping the weight to about 160 pounds, yet of sufficient strength to support a load of up to 1500 pounds.

Other objects, features and advantages of the invention will be apparent from the following specification and drawings.

DETAILED DESCRIPTION OF THE PREFERRED EMBODIMENT

Figure 1:
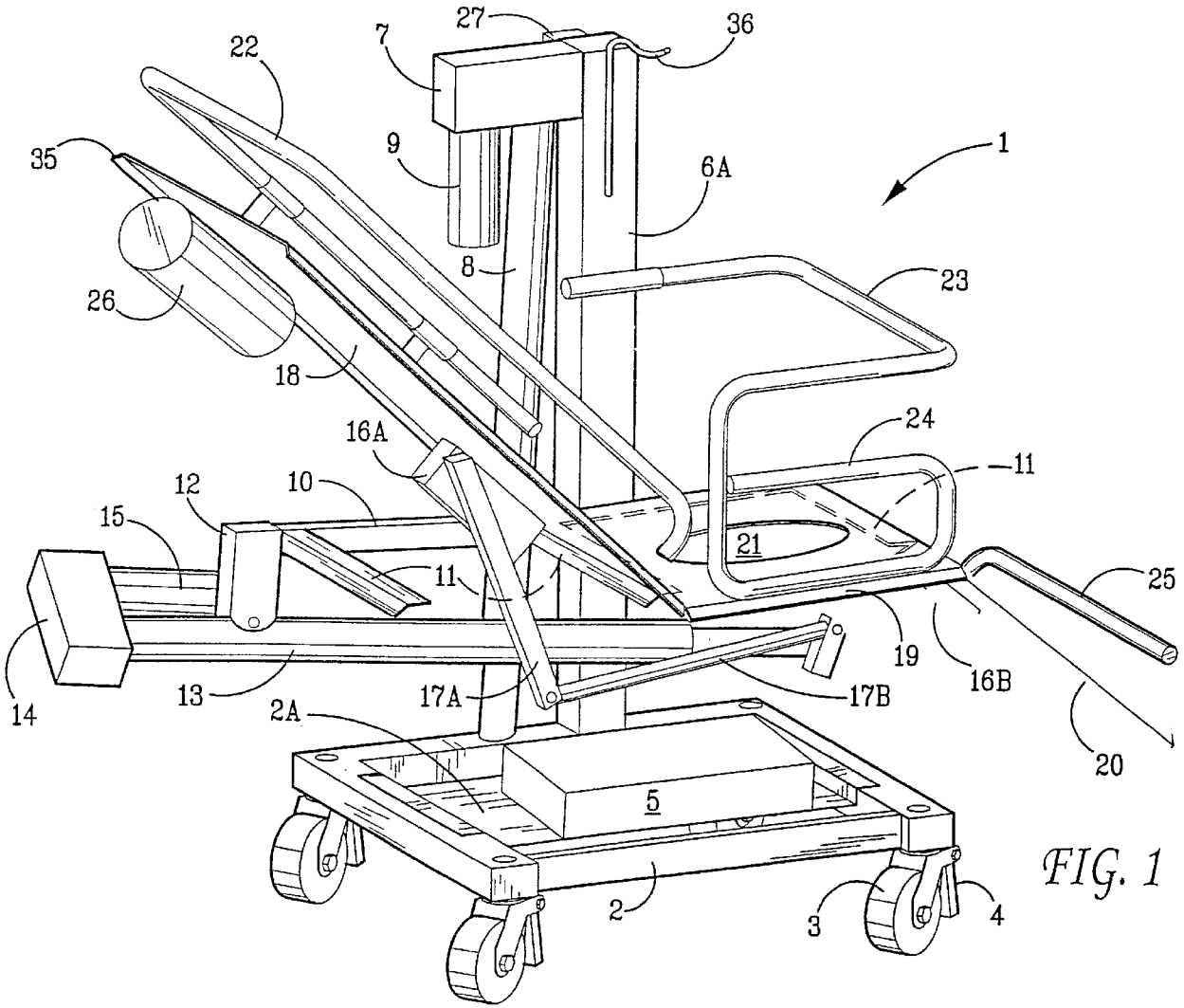
FIG. 1 is a perspective view of the cantilevered mobile bed/chair apparatus in accordance wit the invention shown in the chair mode.
Figure 2:
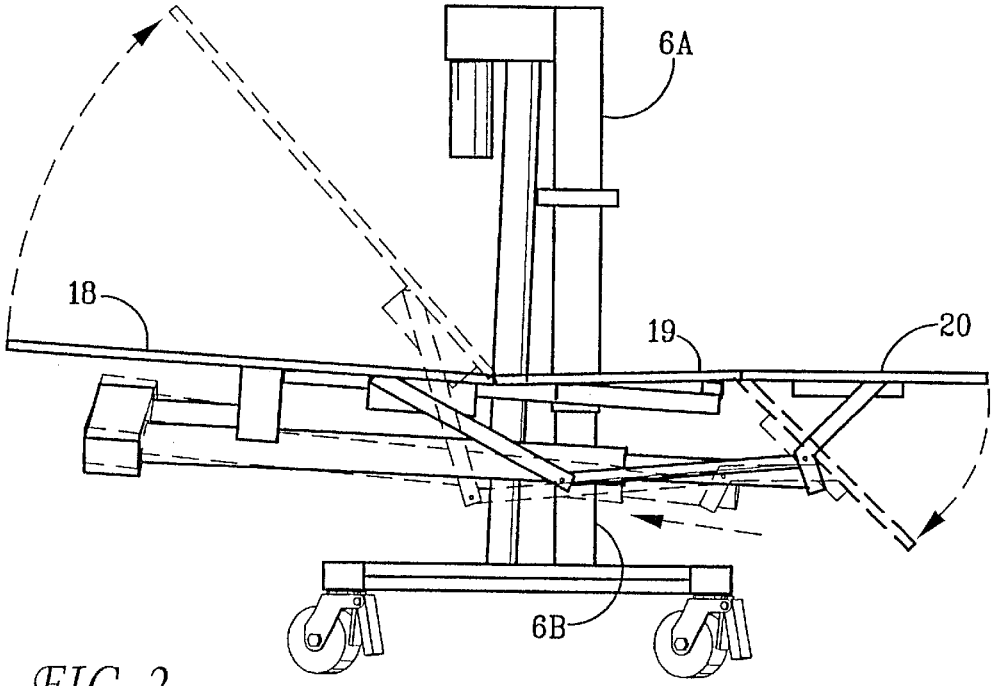
FIG. 2 is a front view of the apparatus showing the bed mode converting to the chair mode in phantom.
Figure 5:
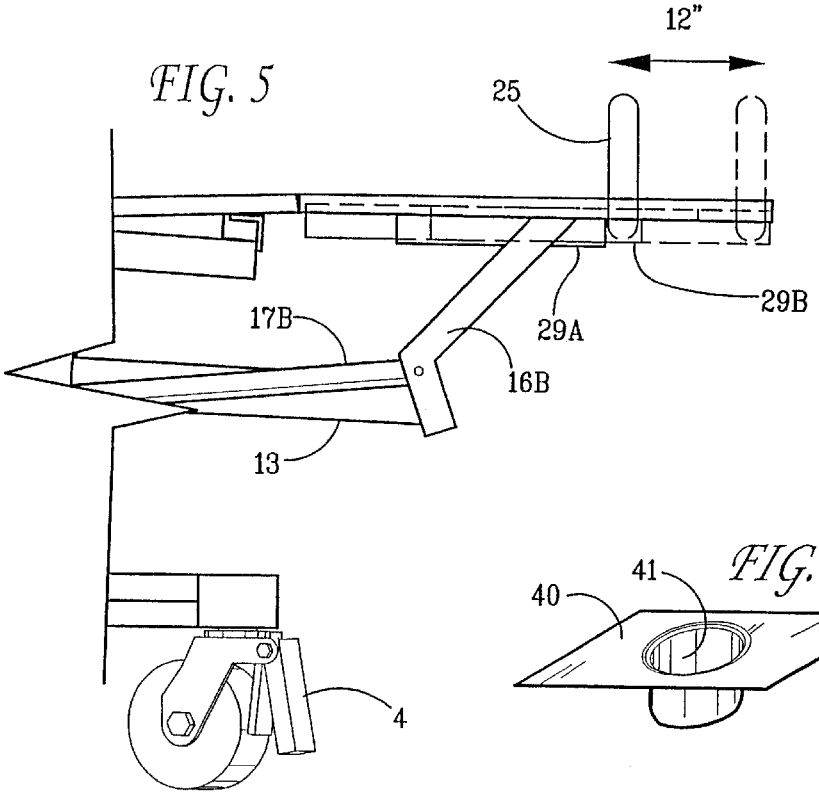
FIG. 5 shows respectively cut-away side view sections of the adjustable foot rest, and wheel and lock mechanism forming a part of the invention.

Turning to FIG. 1, the overall cantilevered bed/chair apparatus is indicated by 1. A rectangular base 2, made from steel or an equivalent material, provides support for four omni-directional wheels 3, each with a locking mechanism 4. The wheels, seen in greater detail in a cut-away section view in FIG. 5, are five inches in diameter, and are conventional off-the-shelf items such as No. 3W804 Swivel Stretcher Caster with Central Locking System Stem by Wagner. While not shown in the preferred embodiment, the wheels may be motorized in any well known manner, such as shown by the Ezenwa patent referred to above to convert the apparatus to a powered wheelchair. A tray 2A nestles within base 2 to provide support for a 12 volt, dry cell battery and battery charger generally indicated at 5. The battery and charger therefor are conventionally known, such as the "Jump-N-Carry 400" from K & K Jump Start/Chargers, Inc. of Kansas City, Mo. A telescoping tower 6A–6B, made of three and one-half inch square steel for upper section 6A, and three inch square steel for lower section 6B, and, designed to lift 2500 pounds, is mounted on one side of rectangular base 2. Aluminum or other materials may be used instead of steel for the tower without departing from the spirit and scope of the invention herein. The telescoping sections 6A and 6B are raised and lowered by way of a jack 8 supported by a block 7. Jack 8 in the best mode of operation embodiment is a motorized screw jack that is capable of working either by hand or with a motor 9. The motorized jack is a known 12 volt DC motorized jack, such as "Hi-Torque Acme Power Jack" made by H & H Engineering of Battle Creek, Mich.

Attached to the tower in cantilever fashion, at about mid-way, is an E shaped frame having a back 10 and arms 11. Two of the arms 11 are located under, and are attached to a seat platform 19 on either side of a potty hole 21. These arms are made of steel, and are L-shaped in cross section for strength. While L-shaped channel steel is shown, it is apparent that other well known designs for strength, and materials may be employed with equal results. The third arm 11 for the E-shaped frame is located approximately midway along a back platform 18, and provides operative support therefor when in the bed mode. The back and seat platforms 18 and 19 are hinged together by a piano hinge, shown in detail in FIG. 6. The seat platform is then connected also by piano hinge to a foot platform 20. The three platforms are made of ⅜ inch aluminum with beveled down edges, and measures twenty four and one-half inches wide by three feet long for back platform 18, eighteen inches long for seat platform 19, and eighteen inches long for foot platform 20, for a total of six feet in length. The beveled edges of the platforms perform a dual purpose, viz.; for providing rigidity for the platforms, and, for effecting an important aspect of the operation of the apparatus, to be described later with respect to FIGS. 4A–4D. While aluminum is disclosed for the material used in the platforms, it is apparent that other materials may be used including steel, plastic or fibreglass without departing from the spirit and scope of the invention. Arms 11 connected to back 10 of an E shaped frame extend approximately two thirds the width of the platforms, and together with platforms 18–19–20, are designed to support a load of 1500 pounds. The three platforms are caused to change position by way of pivoting levers 17A–17B connected to back and foot platforms 18 and 20 by way of anchor blocks 16A and 16B respectively. Anchor blocks 16A–16B are connected approximately four inches from the tower side of the platforms. The location of anchor blocks 16A–16B is important because this will leave approximately 18 inches cantilever overhang for the remainder of the platforms that is free of all obstacles. This can be more clearly seen in FIG. 3. A second jack 13 controls the movement of pivoting layers 17A–17B. Jack 13, like jack 8, is a screw jack that is mounted to back 10 of the E frame with block 12, and is controllable, also like jack 8, either by hand or by a motor 15 supported at 14. It is apparent that other classes of jacks may be employed, such as hydraulic and scissors without departing from the spirit and scope of the invention.

Attached to back platform 18 is a swing away safety guard rail 22 that encircles the patient for safety, while attached to tower 6A is a swing away food tray holder and arm rest combination 23–24 for patient service. An adjustable foot rest 25 attaches to foot platform 20 in a manner described further down with respect to FIG. 5. An oxygen tank holder 26 is conveniently attached longitudinally along the tower side and near the top of back platform 18. An electronic auto seat reposition timer module 27 attaches to the back of tower section 6A, while an IV holder 36 attaches to the front of tower section 6A. Time module 27 is an off-the-shelf item such as "Universal Timer, Model UT-1" from Alarm Controls Corp., Deer Park, N.Y. This timer controls the periodic repositioning of the bed/chair apparatus when in the chair mode, so that bed sores of an immobilized patient are minimized. Not shown in order to minimize clutter in the figures, are VELCRO safety straps attachable at various points along platforms 18–19–20. For example, the inventors hereof have attached their VELCRO safety straps at the back and foot platforms. It is apparent that such straps may be attached anywhere for optimum patient safety without departing from the spirit and scope of the invention.

OPERATION OF CANTILEVERED MOBILE BED/CHAIR

Figure 3:
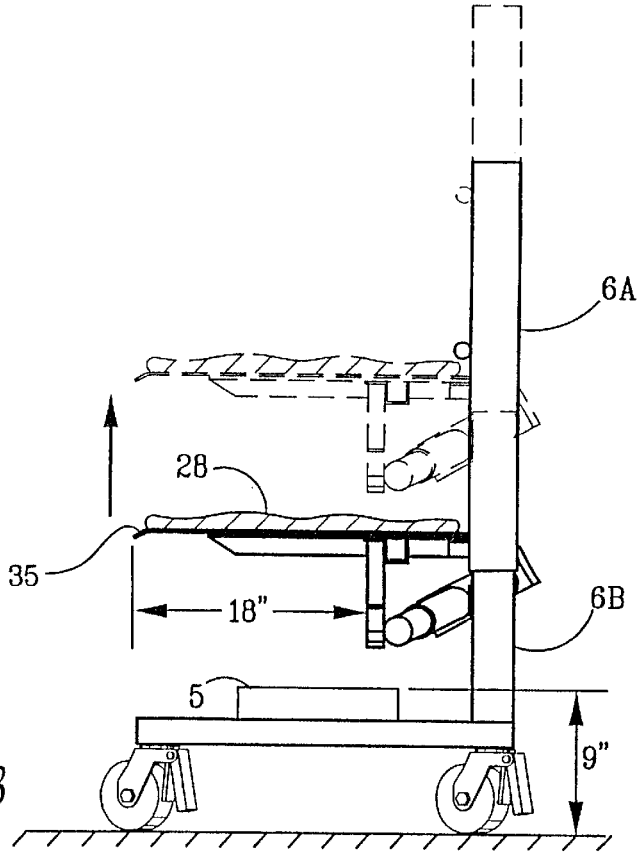
FIG. 3 is a side view of the apparatus showing the cantilevered bed/chair in the bed mode at two different heights.

The operation of the cantilevered bed/chair will be described with reference to FIGS. 2–8. Some of the reference numbers for already identified elements have been omitted in order to keep figure clutter to a minimum. Looking at FIG. 2, the bed/chair apparatus is shown in the bed mode converting to a chair mode seen in phantom lines. It is noted that back platform 18 and foot platform 20 pivot about seat platform 19 which is securely mounted to the E shaped frame. The back and foot platforms move in opposite directions by action of under the seat jack 13 connected to levers 17A–17B (identified in FIG. 1). Thus, as the jack extends, the platforms flatten out to form a bed. A chair is formed when the jack contracts. Jack 13 and connecting levers and blocks are all mounted near tower 6A–6B so as to permit maximum cantilever overhang. This is clearly seen in FIG. 3 which shows an eighteen inch overhang for the cantilevered platforms. Also seen in FIG. 3, is a nine inch height for wheeled base 2 and battery/battery charger 5 combination to enable clearance under a typical hospital bed with a lowered guard rail. FIG. 3 depicts the cantilevered bed/chair in the bed mode at two different heights. The height is controlled as jack 8 extends to expand telescoping tower 6A–6B. That is, patient platforms 18–19–20, supported by E shaped frame 10–11 attached to section 6A of the telescoping tower, changes height as section 6B of the telescoping tower remains fixed to base 2. The bed has a vinyl covered foam pad 28 of about one inch thickness for patient comfort.

Figure 4A:
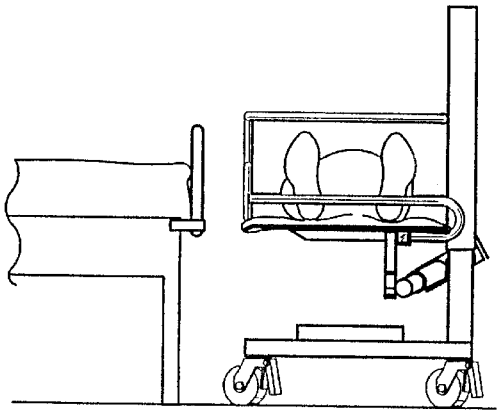
FIGS. 4A–4D shows a step by step procedure for the safe transfer of a patient from the cantilevered bed/chair apparatus to a hospital type bed.
Figure 4B:
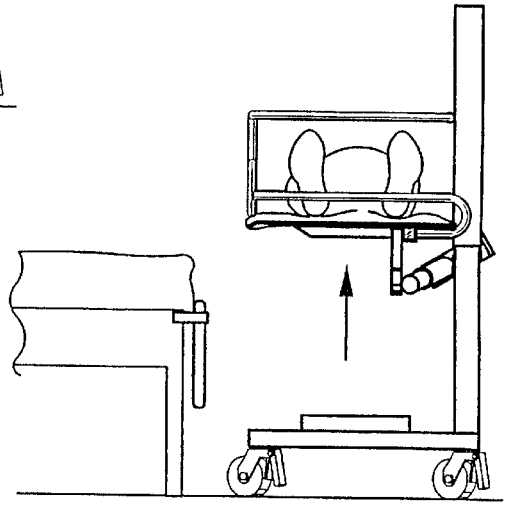
Figure 4C:
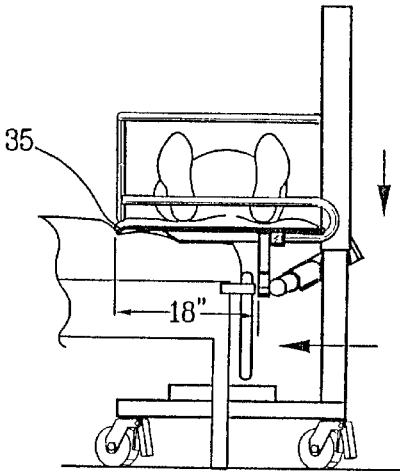
Figure 4D:
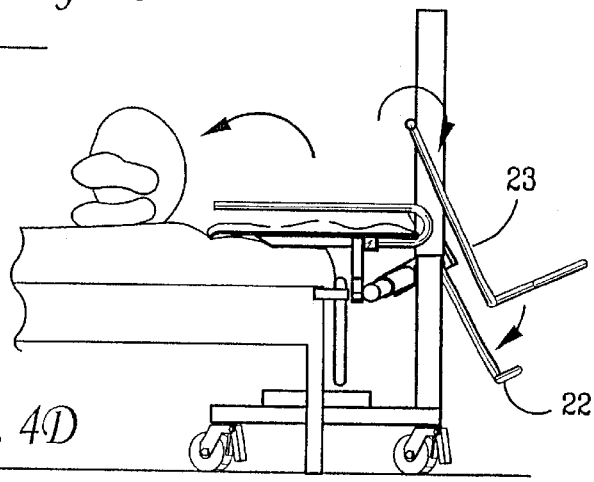

FIGS. 4A–4D show the typical patient transfer procedure for the invention. FIG. 4A shows the patient being transferred in gurney fashion to a hospital type bed with the guard rail up. The height of the cantilevered bed is raised, in FIG. 4B, above the hospital type bed by up to eighteen inches as shown in FIG. 4C, and then lowered so as to press into the mattress of the hospital type bed. The pressing in feature of the cantilevered bed is enhanced by the beveled or angled down edges 35 of platforms 18–19–20. It has been found that with the beveled edges pressing into the mattress, together with the relatively thin construction of the platforms (⅜ inch thick aluminum), the side profile of the two beds is almost flat even with a one inch foam pad on the cantilevered bed. Moreover, because the beveled edges "bite" into the hospital type bed's mattress, virtually no movement occurs between the two beds, which greatly facilitates the patient transfer procedure, even by one caregiver. Thus, in FIG. 4D, safety rail 22 and food tray holder/arm rest rail 23/24 are swung back, and the patient is easily rolled over onto the hospital type bed. Should it be necessary to move a patient from a hospital type bed to the cantilevered bed apparatus, the above described procedure would be reversed.

FIG. 5 shows the adjustable foot rest feature of the invention. Since patients come in many different heights, foot rest 25 attaches to a lower bar 29B which slides telescopically in box shaped channel 29A fixed underneath foot platform 20. Thus, if a patient is taller than average, the foot rest is extended and locked in position to provide appropriate foot support. The foot rest is shown with a twelve inch adjustment. This provides accommodation for patients of up to seven feet in height. It is obvious that greater adjustments may be made with foot rests constructed with larger dimensions for bar 29B. As noted above in the description of FIG. 1, wheel 3, also shown in FIG. 5, has a diameter of five inches. This has been found sufficient to accommodate the many different type floor surfaces of most provider institutions.

Figure 6A:
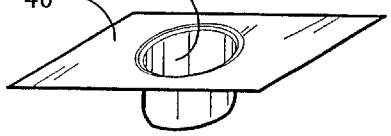
FIG. 6A is a view of a bed pan useable with the cantilevered bed/chair apparatus.
Figure 6B:
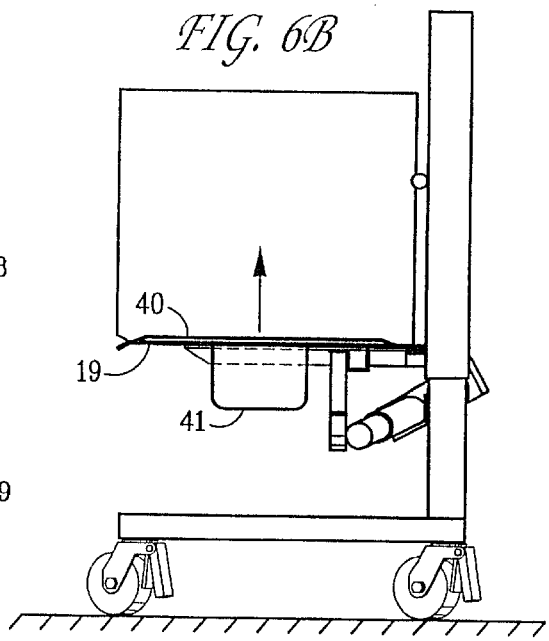
FIG. 6B is a view of the bed pan in FIG. 6*a* in use with the cantilevered bed/chair.
Figure 6:
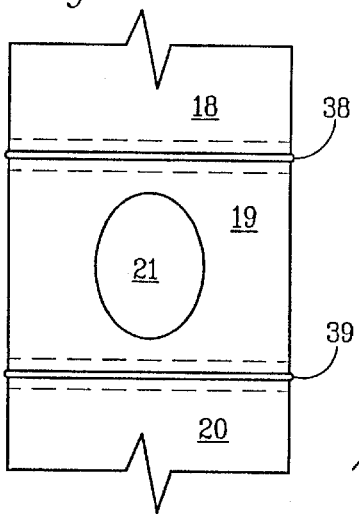
FIG. 6 is a partial top view of the three hinged together platforms forming the patient support with the middle seat section showing an oval shaped potty hole.

FIG. 6 shows piano hinges 38 and 39 which, as is well known, have an almost flat profile, yet are extremely strong. These hinges, as mentioned above interconnect platforms 18, 19 and 20, and are capable of a long, trouble free useful life. Seat platform 19 has an eight inch by twelve inch elliptical potty hole 21, useful for increased patient maintenance.

FIG. 6A discloses a bedpan specifically designed for use with the bed/chair of the invention. The bedpan has a flange 40 and receptacle 41. The cross-sectional shape of the receptacle 41 is substantially identical to the shape of the potty hole 21. FIG. 6B shows the bedpan in use with the bed/chair. In use, the receptacle 41 extends through the hole 21 and the flange 40 rests upon the platform 19. The large flat flange provides for comfortable use by the patient. The bedpan is easily installed and removed as necessary.

Figure 7A:
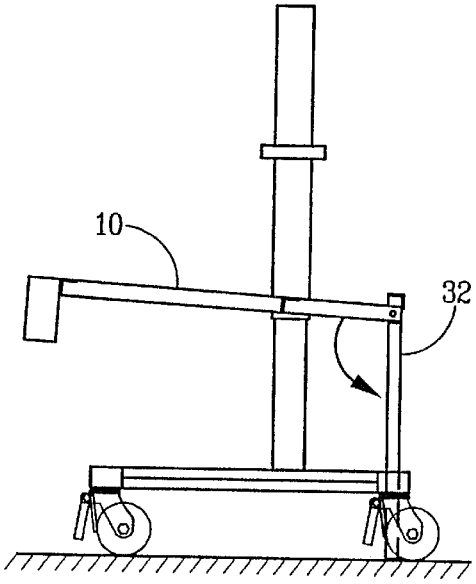
FIGS. 7A–7B show one method of operating the bed/chair apparatus in the Trendelenburg position.
Figure 7B:
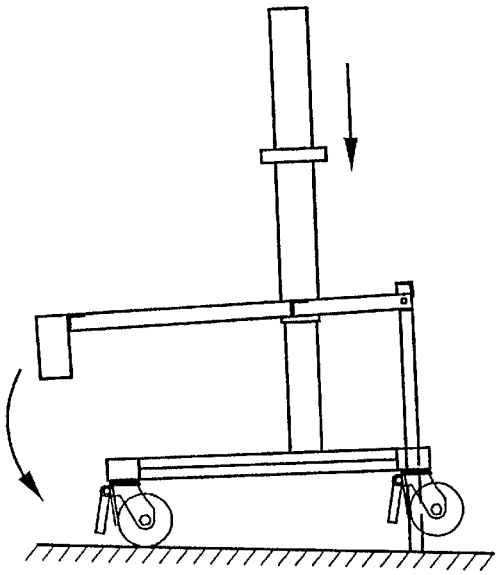
Figure 8:
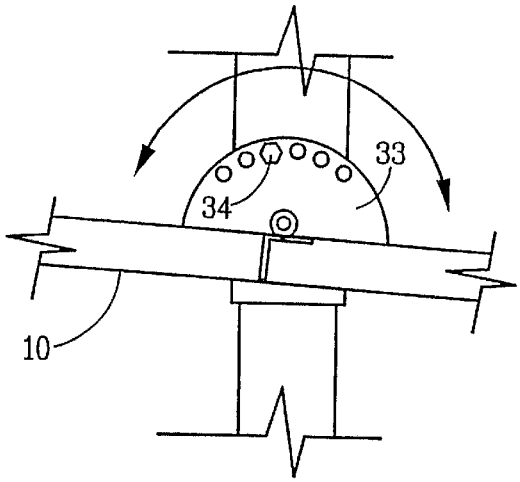
FIG. 8 shows a second method of operating the bed/chair apparatus in the Trendelenburg position.

FIGS. 7 and 8 describe two methods of performing the Trendelenburg position that may be employed in the apparatus herein. This is the position where the head of a patient is made lower than their feet, such as is necessary with some patients suffering from certain heart conditions, or patients in shock. In FIGS. 7A–7B, the Trendelenburg position can be effected with a simple, yet effective swing down bar or jack 32. The bar is normally in a raised horizontal position next to E shaped frame back 10. When it is desired to employ its use, bar 32 is swung down in a vertical position in front of and between the front wheels as shown in FIG. 7A. As the tower is lowered, bar 32 at first makes contact with the floor, and then begins jacking the front half of the apparatus off the floor as shown in FIG. 7B. A second method for effecting the Trendelenburg position is shown in FIG. 8. This method employs a gear and locking pin arrangement in which a gear 33 is fixed to E shaped frame back 10, and to tower 6A by way of a center load bearing or axle. When it is desired to employ the Trendelenburg position, a pin 34 is pulled from a center hole of a series of holes, the platforms tilted to the appropriate position, and the pin reinserted in an off-center hole as shown. Other obvious methods may be employed without departing from the spirit and scope of the inventive apparatus herein. For example, means may be provided for raising the foot platform above the horizontal plane so that the patients legs are raised above their head. Such a means might take the form of a third screw jack connected between a modified lever 17B and the foot platform, to thereby cause only the foot platform to raise when the third jack is extended.

Figure 9:
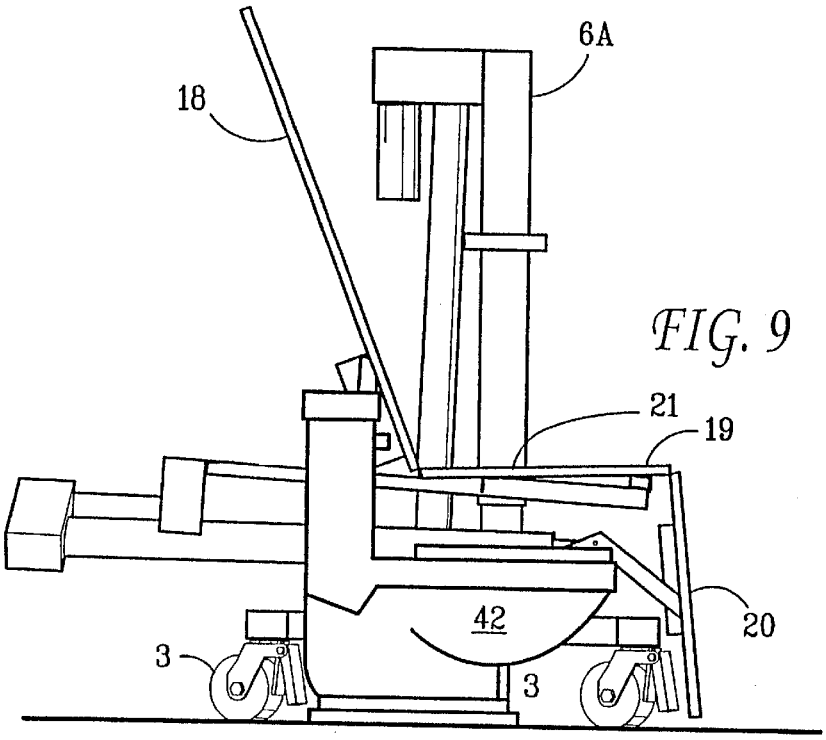
FIG. 9 shows an embodiment of the invention having a base with three rails positioned about a toilet.
Figure 10:
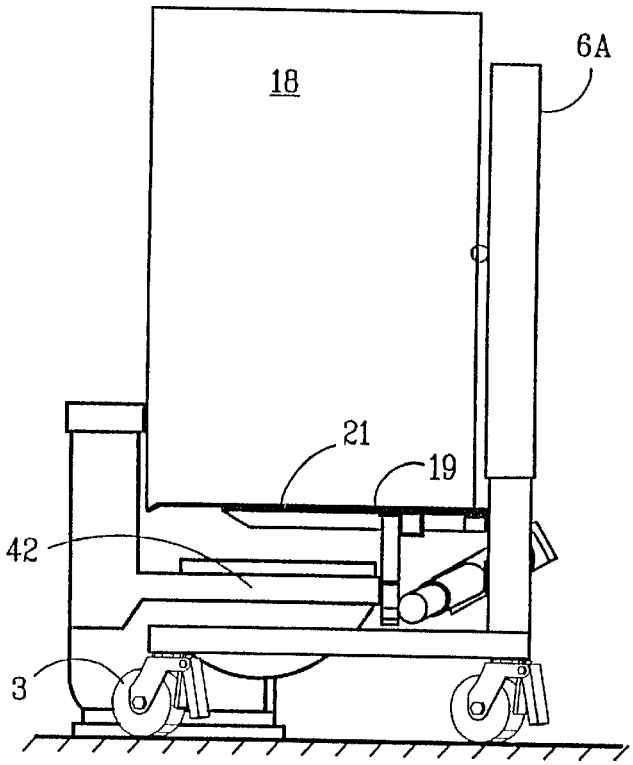
FIG. 10 shows the cantilevered bed/chair having three rails positioned sideways about a toilet.
Figure 11:
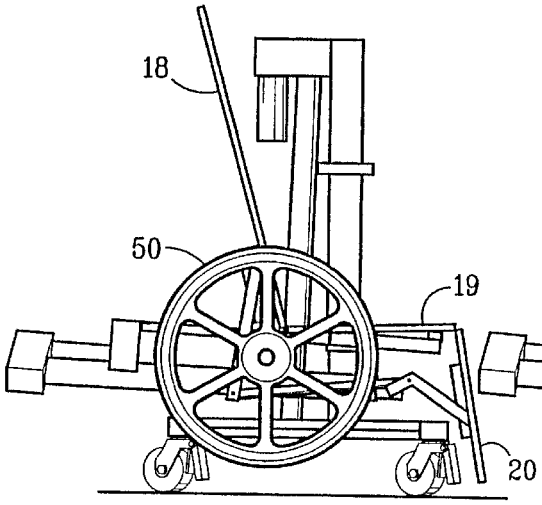
FIG. 11 shows an embodiment of the cantilevered bed/chair having large wheels attached to the bed frame.

FIGS. 9 and 10 disclose an embodiment of the bed/chair having a base that can surround a toilet thereby placing the seat platform 19 over the toilet. The base of the bed/chair has three rails forming a U-shape with a wheel 3 at each corner of the base. This differs from the base shown in FIG. 1 in that the rail 2 and battery platform 2A are deleted. This can be accomplished in two ways. The base can be formed in this manner and the battery 5 can be moved to a different location, such as mounted on one of the remaining rails of the base. Also, the rail 2 and battery platform 2A can be made to be removable. When it is desired to position the bed/chair about a toilet, the rail and platform would be moved and the bed is so positioned. Afterwards, the rail and battery platform could be reattached.

FIG. 9 shows the bed/chair positioned with the back platform 18 resting against the tank of the toilet. In this manner, the leg platform 20 extends in front of the toilet and the seat platform 19 is positioned over the toilet 42. In an alternative use of the same device, the bed/chair can be positioned so that the tower 6A is in front of the toilet and the two sides of the base extend along either side of the toilet. In this manner, the seat platform 19 and potty hole 21 are still positioned over the toilet 42. Either of these arrangements could be used depending on the ease in maneuvering the bed/chair into position. The result in either position is the same in that the seat platform 19 is positioned over the toilet. The patient can choose either position depending upon what is most convenient.

Figure 12:
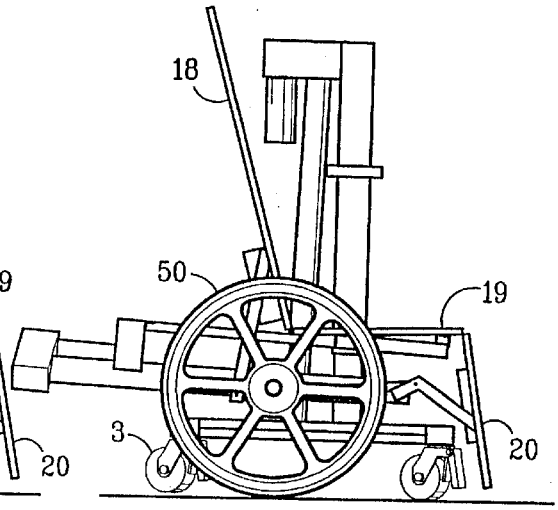
FIG. 12 shows an embodiment of FIG. 11 with the wheels engaged with the ground.

FIGS. 11–14 disclose a bed/chair that allows forward movement by the patient. In this embodiment, a large wheel 50, common to the type used as rear wheels in wheel chairs, is connected to the frame. As the bed frame is lowered, the large wheel 50 engages the ground and, as the frame is further lowered, the rear wheels are lifted off the ground. This arrangement is shown in FIG. 12. Once the rear wheels are lifted off the ground, the patient can roll the bed/chair forward by rolling the wheels 50. The top of the wheels 50 extend above the seat platform 19 and are easily accessible by the patient.

Figure 13:
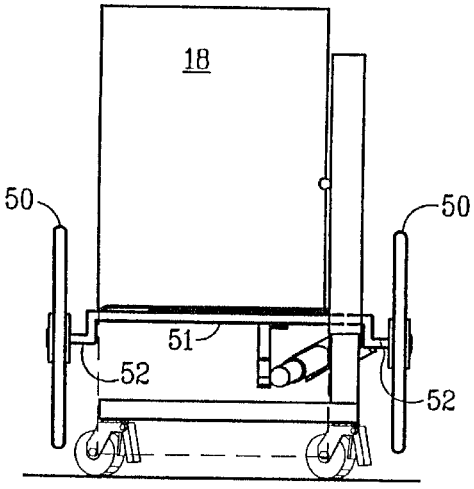
FIG. 13 shows a back view of the embodiment shown in FIG. 11.
Figure 14:
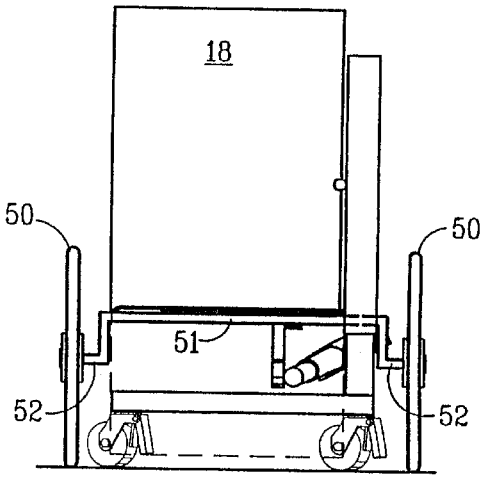
FIG. 14 is a rear view of the embodiment of FIG. 12.
Figure 15A:
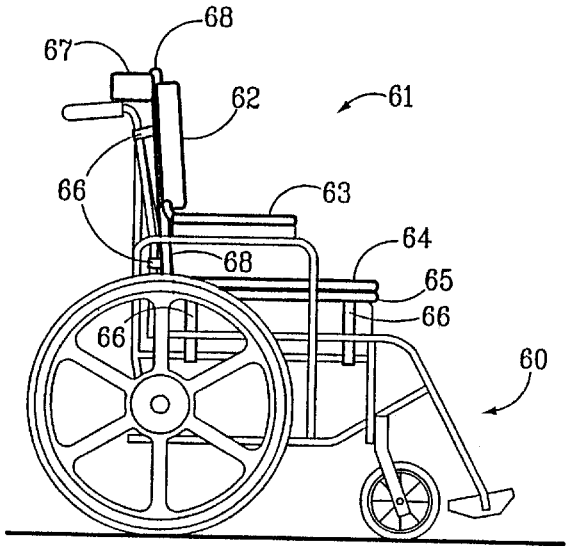
FIG. 15A is a side view of a wheelchair apparatus having a lift assist mechanism.
Figure 15B:
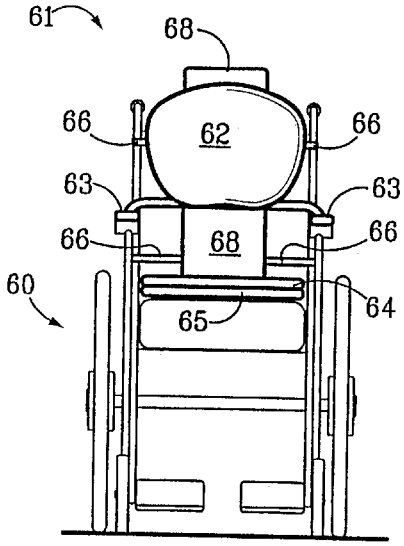
FIG. 15B is a front view of a wheelchair having a lift assist mechanism.
Figure 16A:
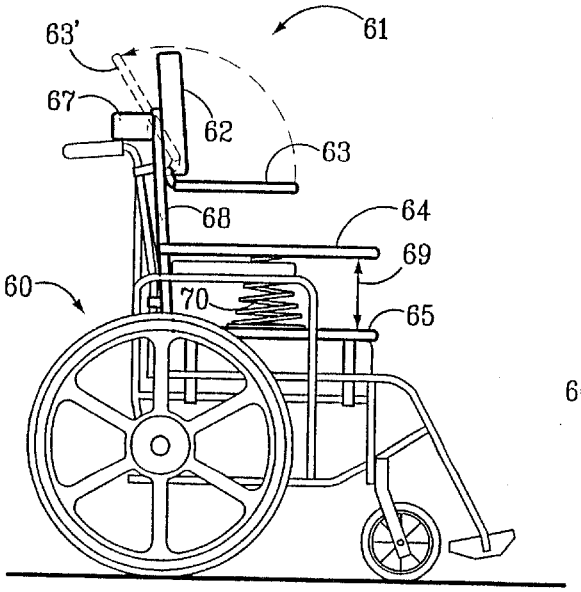
FIG. 16A is a side view of the lift assist mechanism raised.
Figure 16B:
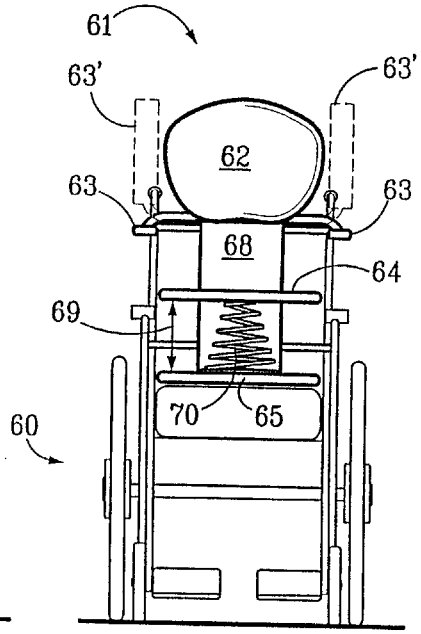
FIG. 16B is a front view of the lift assist mechanism raised.

The rear view of this embodiment is shown in FIG. 13. In this figure, it is seen that the wheels 50 are connected to a pair of axles 52, one on each side of the bed/chair. The two axles are connected by a common rod 51. It is envisioned that quick release wheels 50 are used so that they may be easily attached and detached from the axle 52. Such wheels are conventionally known in the art.

FIGS. 15A–16B disclose a lift mechanism for a wheelchair. The wheelchair 60 has a seat portion 65 and a back rest portion 65 and pivotable armrests 63. A series of straps 66 are used to help retain a patient in the chair. The lift assist mechanism consists of a platform 64 lifted by a motor 67. Any number of conventional means 68 are used to connect the motor 67 with the platform 64, such as a screw jack or pump jack.

Positioned between the seat 65 and the platform 64 is a spring 70. The spring 70 has a lifting force of 40–50 pounds. While this force is not sufficient alone to lift a patient, it reduces the amount of weight that is lifted by the motor 67. Under normal conditions, the patient's weight collapses the spring but during lifting the spring aids the motor in lifting a patient. When lifting of the patient is desired, the armrests 63 are pivoted backwards out of the way. The motor is engaged and the platform 64 is lifted up the rail 68 to a height so that the patient clears the frame of the wheelchair. Once lifted to the height 69, the patient can be slid laterally onto another chair or bed. Such a device consisting of the seat platform 65, the lifting platform 64, the motor 67, spring 70 and rail 68 can be retrofitted onto an existing wheelchair or any other type of chair.

Figure 17:
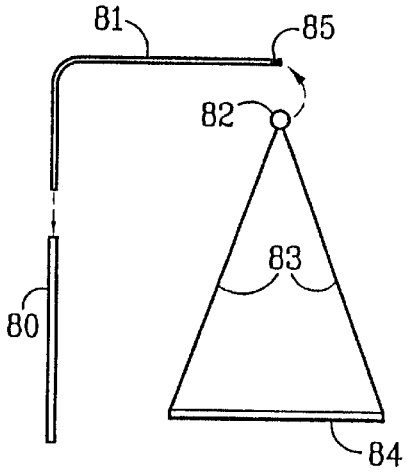
FIGS. 17–19 depict a mechanism for raising a patient's knees upward.
Figure 18:
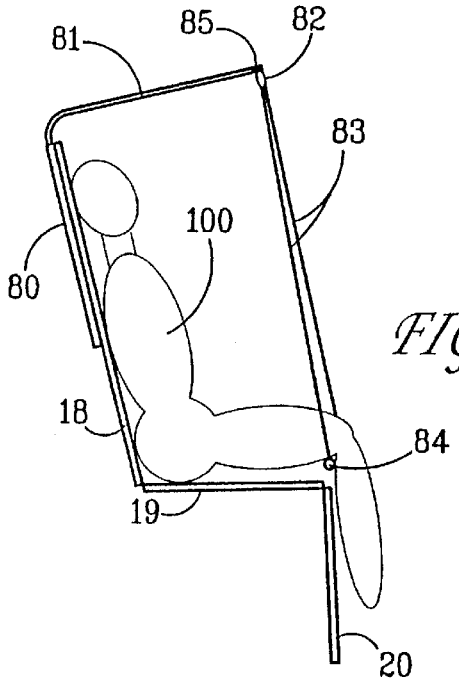
Figure 19:
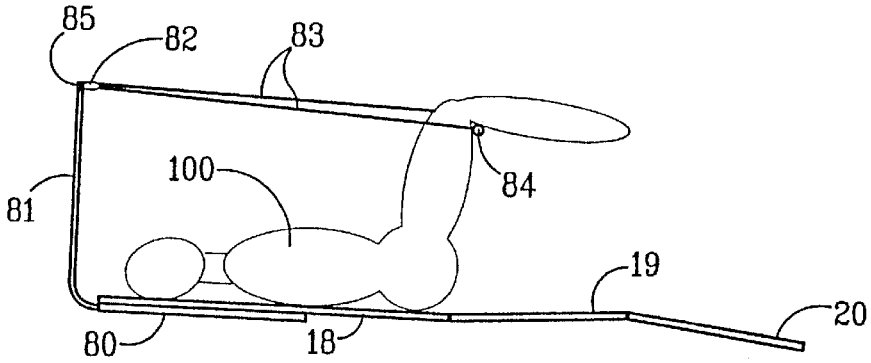

FIGS. 17–19 show a mechanism for lifting the patient's legs. The device includes a tube 80 attached to the head platform 18 of the bed/chair. Fitting within and attached to the tube 80 is a right angle rod 81. At the end of the cantilevered section of the rod 81 is a hook 85. A ring 82 fits onto the hook 85. Extending from the ring 82 are two flexible cables 83. A padded rod 84 is connected between the ends of the flexible cables 83 to provide a triangle support.

As shown in FIG. 18, when the bed/chair is in the chair configuration, the padded rod 84 is positioned beneath the knees of the patient 100. As the head platform 18 is lowered, the tube 80 is moved to a near horizontal position. This results in the right angle rod 81 extending upwardly and the hook 85 positioned above the patient's head. The cables 83 pull the padded rod 84 and therefore the patient's knees upwardly. The tendency for the patient's legs to want to fall back to a horizontal position maintains tension in the flexible cables 83. In such a position, the patient 100 can be cleaned and any sheets on the bed/chair can be more readily changed.

Other features are envisioned for the cantilevered mobile bed/chair apparatus herein. For example, a means for weighing patients while on the apparatus has been successfully tested. Such a means involves a set of two, six inch strain gauge strips glued to the front and back side of tower section 6B near base 2. The strain gauges are connected to a highly sensitive Wheatstone bridge circuit so that any strain on the tower due to a load (such as a patient) on the platforms, translates to a weight on an appropriate scale. Such strain gauges and Wheatstone bridge circuits are known in the art, and may be commercially obtained from e.g., Omega Engineering, Inc. of Stamford, Conn.

The cantilevered mobile bed/chair apparatus disclosed herein weighs only about 160 pounds so as to be portable, and thereby be useful under numerous circumstances and environments. And, despite its many sophisticated features, and its ability to support a load of 1500 pounds, the apparatus herein is designed to be rugged and long lasting.

Figures 20, 21:
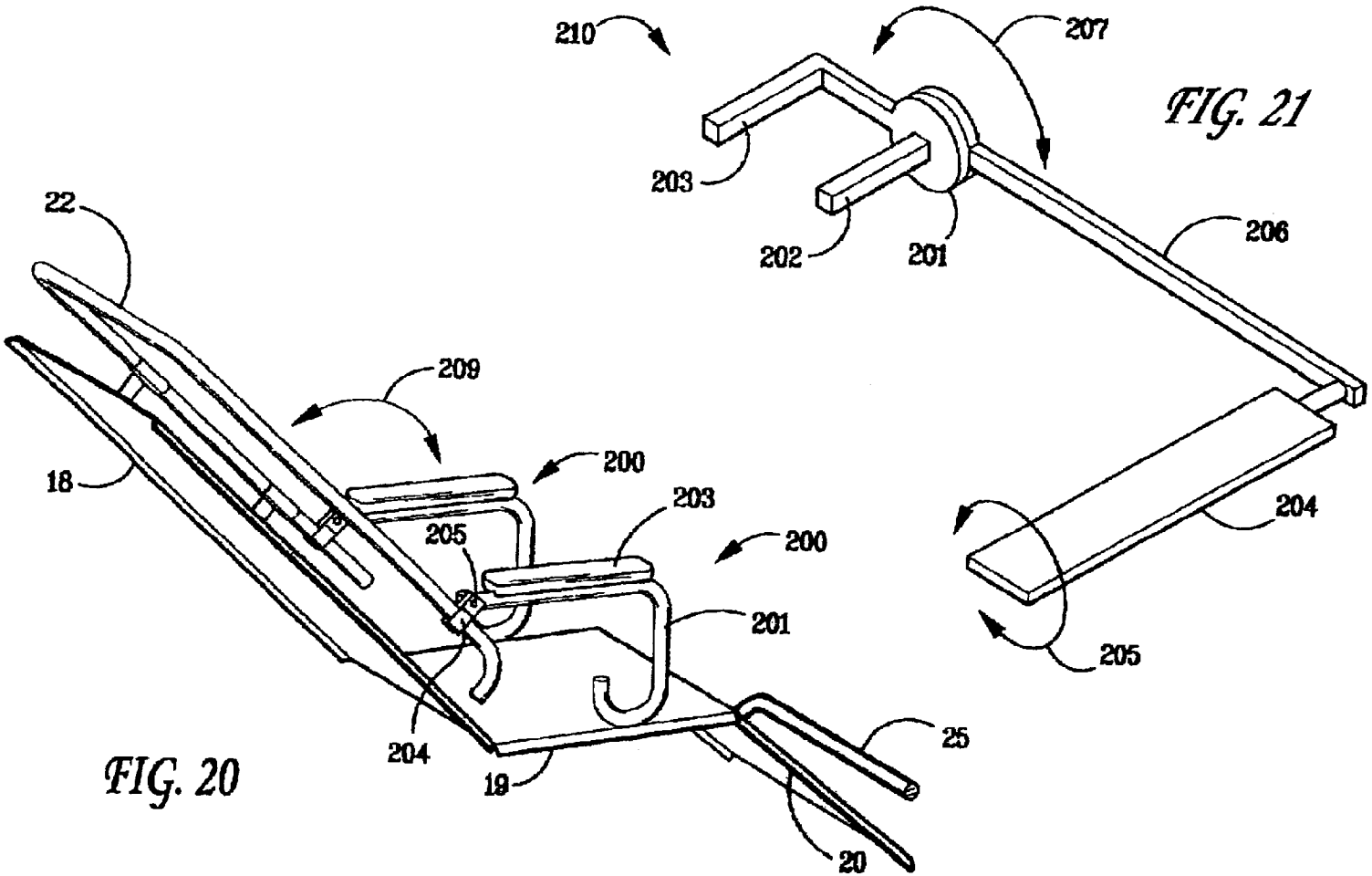
FIG. 20 shows the mobile bed apparatus having railings.
FIGS. 21–24 show an alternative embodiment of a patient leg lift.

An embodiment having rails surrounding the seat is shown in FIG. 20. As can be seen, the head platform of the patient support 18 is provided with a U-shaped rail 22 that extends along each side and the top of the platform. On the far side of the platform, as shown in FIG. 20, the rail 22 is pivotally attached to the head platform 18. This allows the railing to be moved out of the way during patient transport on and off the patient support. Arm rests 200 are attached to the bottom of the U-shaped rail 22. The arm rests have pads 203 for the comfort of the patient. More importantly, the arm rests are attached to the rail 22 by a pivoted connection to collar 204. Collar 204 is slidably maintained on the rail 22 and pivotally connected to the arm rests by pin 205. As the angle of the head portion 18 relative to the seat portion 19 is changed from the seat to the bed configuration, the collar slides downwardly along the rail. As can be seen, one side is provided with a downwardly depending portion. The collar 204 can slide along the rail until the top of the arm rail 201 is substantially co-linear with the two side portions of the rail 22.

FIGS. 21–24 disclose an alternative patient leg support. The mechanism itself is shown in FIG. 21. The mechanism has a first L-shaped member 203 and a main member 206. A padded member 204 extends from the end of main member 206. Padded member 204 can rotate to accommodate its changing angle. It is best for the comfort of the patient that the padded platform 204 remain parallel to the seat platform 19. Since the angle of the main member 206 changes as it is used to raise the patient's legs, it needs to be pivotally connected. The angle of the main member 206 relative to the L-shaped member 203 is accomplished by the pivoting joint 201. The pivoting joint has an extension 202 for attaching the leg lifting apparatus to the bed, and can be locked to maintain the position of the main member 206 relative to the L-shaped member 203. The range of motion is shown by arrow 207 and the pivot joint 201 does have a ratchet action.

Figure 22:
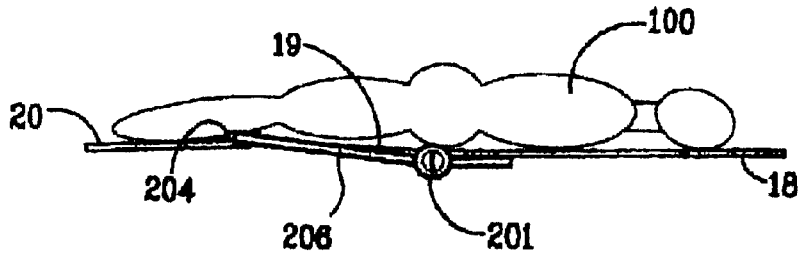

FIG. 22 shows the patient support in the flat, bed configuration. As can be seen, the main member 206 extends along the side of the platform so that the padded platform 204 is positioned below the patient's knees. In this configuration, the main member 206 is substantially coplanar with the L-shaped member 203.

Figure 23:
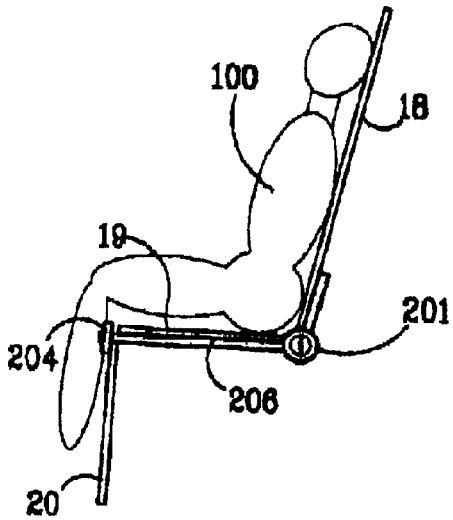

The mechanisms as used when the device is in the seat configuration is shown in FIG. 23. The padded platform 204 remains below the patient's knees, as can be seen, the angle of the padded platform 204 is now different as it is perpendicular to the main member 206. This maintains the padded platform 204 in the best position for the patient's comfort. Also seen is the angle of the main member 206 relative to the L-shaped member 203. The L-shaped member 206 is parallel to the head platform 18 whereas the main member 206 is parallel to the seat platform 19.

Figure 24:
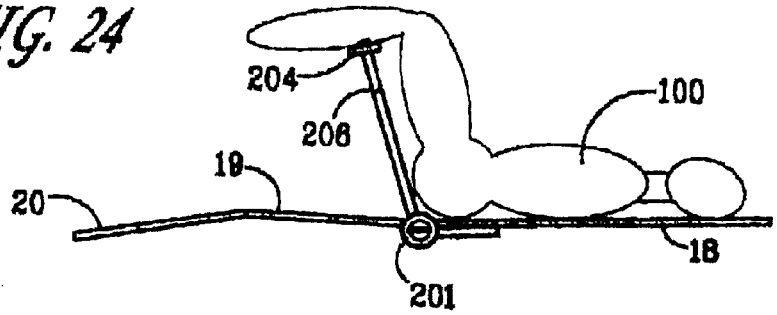

If the main member 206 and L-shaped member 203 are locked in the position shown in FIG. 23, the device can be used to lift the patient's legs in an easy manner. If the head platform 18 is lowered until it is substantially coplanar with the seat platform 19, the seat platform will push against the L-shaped member 203 and the main member 206 will extend upwardly above the patient support. This configuration is shown in FIG. 24. Throughout the transition, the padded platform 204 can pivot so that it remains in contact with the patient's legs for the patient's comfort. The bottom of the patient's legs now have their weight supported on the platform 204. In this manner, the patient's legs are lifted and maintained in a raised position.

While this invention has been described in conjunction with a preferred embodiment, it is obvious that modifications and changes may be made by those skilled in the art to which it pertains, without departing from the spirit and scope of this invention, as defined by the claims appended hereto.

What is claimed is:

1. A bed, comprising a support surface having a front edge, a rear edge, a first side edge and a second side edge, a leg lifter pivotally connected to said support surface, said leg lifter comprising a pivoting joint, said joint connected to said support surface first side edge, a main member extending from said pivoting joint, and a leg support member extending from said main member and over said support surface.

2. The bed of claim 1, wherein said leg support member is padded.

3. The bed of claim 1, wherein said leg support member can rotate relative to said main member.

4. The bed of claim 1, wherein said leg support member is perpendicular to said main member.

5. The bed of claim 1, further comprising an L-shaped member extending from said pivoting joint.

6. The bed of claim 1, further comprising an attachment member extending from said pivoting joint for connecting said pivoting joint to said support surface side edge.

7. The bed of claim 1, wherein said support surface has a head portion, a seat portion and a foot portion, said head and foot portions pivotably connected to said seat portion.

8. The bed of claim 7, wherein said seat portion has a first side edge, a second side edge, a front edge and a rear edge, said pivoting joint connected to said seat portion first side edge.

9. The bed of claim 8, wherein said foot portion is connected to said seat portion front edge and said head section is connected to said seat portion rear edge.

10. The bed of claim 7, wherein said main member pivots relative to said seat portion.

11. The bed of claim 1, wherein said leg support member is substantially parallel to said support surface front edge.

12. A bed, comprising a support surface for supporting a patient having a front edge, a rear edge, a first side edge and a second side edge, a leg lifter pivotally connected to said support surface, said leg lifter comprising a pivoting joint, said joint connected to said support surface first side edge, a main member extending from said pivoting joint, and a leg support member extending from said main member, wherein rotation of said main member about said pivoting joint raises and lowers the leg support member.

13. The bed of claim 12, further comprising a second member extending from said pivoting joint.

14. The bed of claim 13, wherein said second member is L-shaped.

* * * * *